US005835812A

United States Patent [19]

Earle et al.

[11] Patent Number: 5,835,812

[45] Date of Patent: Nov. 10, 1998

[54] PHOTOGRAPHIC PROCESSING APPARATUS

[75] Inventors: Anthony Earle, Middlesex, England; Joachim P. Simon, Erkrath, Germany

[73] Assignee: Eastman Kodak Company, Rochester, N.Y.

[21] Appl. No.: 799,161

[22] Filed: Feb. 14, 1997

[51] Int. Cl.[6] ..... G03D 13/02

[52] U.S. Cl. ..... 396/636

[58] Field of Search ..... 396/612, 618, 396/651, 652, 598, 599, 603, 620, 636, 641; 226/91, 92

[56] References Cited

U.S. PATENT DOCUMENTS

| | | | |
|---|---|---|---|
| 4,641,939 | 2/1987 | Kitner | 396/603 |
| 5,309,191 | 5/1994 | Bartell et al. | 396/626 |
| 5,311,235 | 5/1994 | Piccinino, Jr. et al. | 396/618 |
| 5,339,131 | 8/1994 | Rosenburgh et al. | 396/632 |
| 5,387,499 | 2/1995 | Earle et al. | 396/620 |

*Primary Examiner*—D. Rutledge
*Attorney, Agent, or Firm*—Frank Pincelli; David A. Novais

[57] ABSTRACT

A photographic processor for processing a photosensitive material. The processor comprising at least one processing section having a generally U-shaped processing channel for holding a processing solution through which the photosensitive material passes. A belt is provided for transporting of the photosensitive material through the generally U-shaped processing channel. The generally U-shaped channel comprises a first generally straight section in which the photosensitive material enters the processing channel, a second generally straight section through which the photosensitive material exits the U-shaped processing channel, and a turn-around section connecting the first and second sections. The turn-around section has a radius of curvature of a predetermined value. The first and second straight sections having a cross-sectional thickness T, and the turn-around section has a cross-sectional thickness TR greater than the cross-sectional thickness T.

18 Claims, 5 Drawing Sheets

PHOTOGRAPHIC PROCESSING APPARATUS

FIELD OF THE INVENTION

The present invention relates to improvements in or relating to photographic processing apparatus and, more particularly, with regard to photographic processors having narrowing processing channels and which use belts for transporting of the photosensitive material therethrough.

BACKGROUND OF THE INVENTION

In typical large photographic processing machines for processing photosensitive material, for example, paper, there is provided a plurality of tanks, each containing a photographic processing solution and a rack disposed therein for transporting of the photosensitive material therethrough. Typically, one or more continuous leader belts are provided for transporting of the photosensitive material to be processed through each of the processing tanks. These leader belts are located to one side of the processing path so as to not interfere with the movement of the photosensitive material along the processing path. The leading end of the photosensitive material is attached to a leader belt by means of a clip, which is typically made of metal. The photosensitive material to be processed is threaded through a slot provided in the clip. The clip has a mounting section which can be easily mounted to the moving belt and then later easily detached after passing the material through the processor.

U.S. Pat. Nos. 5,311,235; 5,309,191; 5,339,131; and 5,387,499 disclose processing apparatuses wherein a thin, narrow processing channel is provided for processing the photosensitive material and a low amount of processing solution is used. It has been found that low volume thin tank type processors provide certain distinct advantages. However, when a belt is used for transporting of a photosensitive material through the narrow processing channel, problems arise when the clip must go through a high radius of curvature, for example, in a U-shaped type processor. If the narrow, thin processing channel is extended around the lower portion of the processing channel, there exists the possibility that the clip can be caught in the processing channel which could result not only in damage to the photosensitive material, but also possible damage to the apparatus. Additionally, use of a belt typically requires a wider processing channel which is contrary to providing a low volume thin tank processor.

Therefore, there exists a need to provide a low volume thin tank processor, which utilizes a belt for transporting of the photosensitive material therethrough and solves the problem of the prior art.

SUMMARY OF THE INVENTION

In accordance with one aspect of the present invention there is provided a photographic processor for processing a photosensitive material, the processor comprising at least one processing section having a generally U-shaped processing channel for holding a processing solution through which the photosensitive material passes. A belt is provided for transporting of the photosensitive material through the generally U-shaped processing channel. The generally U-shaped channel comprises a first generally straight section in which the photosensitive material enters the processing channel, a second generally straight section through which the photosensitive material exits the U-shaped processing channel, and a turn-around section connecting the first and second sections. The turn-around section has a radius of curvature of a predetermined value. The first and second straight sections having a cross-sectional thickness T, and the turn-around section has a cross-sectional thickness TR greater than the cross-sectional thickness T.

In accordance with another aspect of the present invention there is provided a photographic processor for processing a photosensitive material. The processor comprises at least one processing section having a generally U-shaped processing channel for holding a processing solution through which the photosensitive material passes, and a belt for transporting of the photosensitive material through the generally U-shaped processing channel. The generally U-shaped channel comprises a first generally straight section in which the photosensitive material enters the processing channel, a second generally straight section through which the photosensitive material exits the U-shaped processing channel, and a turn-around section connecting the first and second sections. The turn-around section has a radius of curvature greater or equal to 0.01 mm. The first and second straight sections having a thickness T and the turn-around section has a thickness TR equal to or less than the 150% of thickness T.

In accordance with still another aspect of the present invention there is provided photographic processor for processing a photosensitive material. The processor comprises at least one processing section having a tank having generally U-shaped processing chamber and a rack for placement within the chamber. The chamber has a width WT. The rack and tank form a narrow processing channel having a thickness T therebetween for holding a processing solution through which the photosensitive material passes. A belt is provided for transporting of the photosensitive material through the generally U-shaped processing channel. The generally U-shaped channel comprises a first generally straight section in which the photosensitive material enters the processing channel, a second generally straight section through which the photosensitive material exits the U-shaped processing channel, and a turn-around section connecting the first and second sections. The turn-around section has a guide roller having a diameter substantially equal to the width WT.

In accordance with another aspect of the present invention there is provided a photographic processor for processing a photosensitive material. The processor comprising at least one processing section having a generally U-shaped processing channel for holding a processing solution through which the photosensitive material passes, and a belt designed for use with a clip for transporting of the photosensitive material through the generally U-shaped processing channel. The clip has a mounting section for attachment to the belt and a attachment section which hold the photosensitive material. The generally U-shaped channel comprising a first generally straight section in which the photosensitive material enters the processing channel, a second generally straight section through which the photosensitive material exits the U-shaped processing channel, and a turn-around section connecting the first and second sections. The turn-around section having a cross-sectional thickness greater in the area of the mounting section of the clip than the attachment section which holds the photosensitive material.

DETAILED DESCRIPTION OF THE DRAWINGS

Other objects, advantages and features of the present invention will become apparent from the following specification when taken in conjunction with the complete drawings in which like elements are commonly enumerated and in which.

Figure 2:
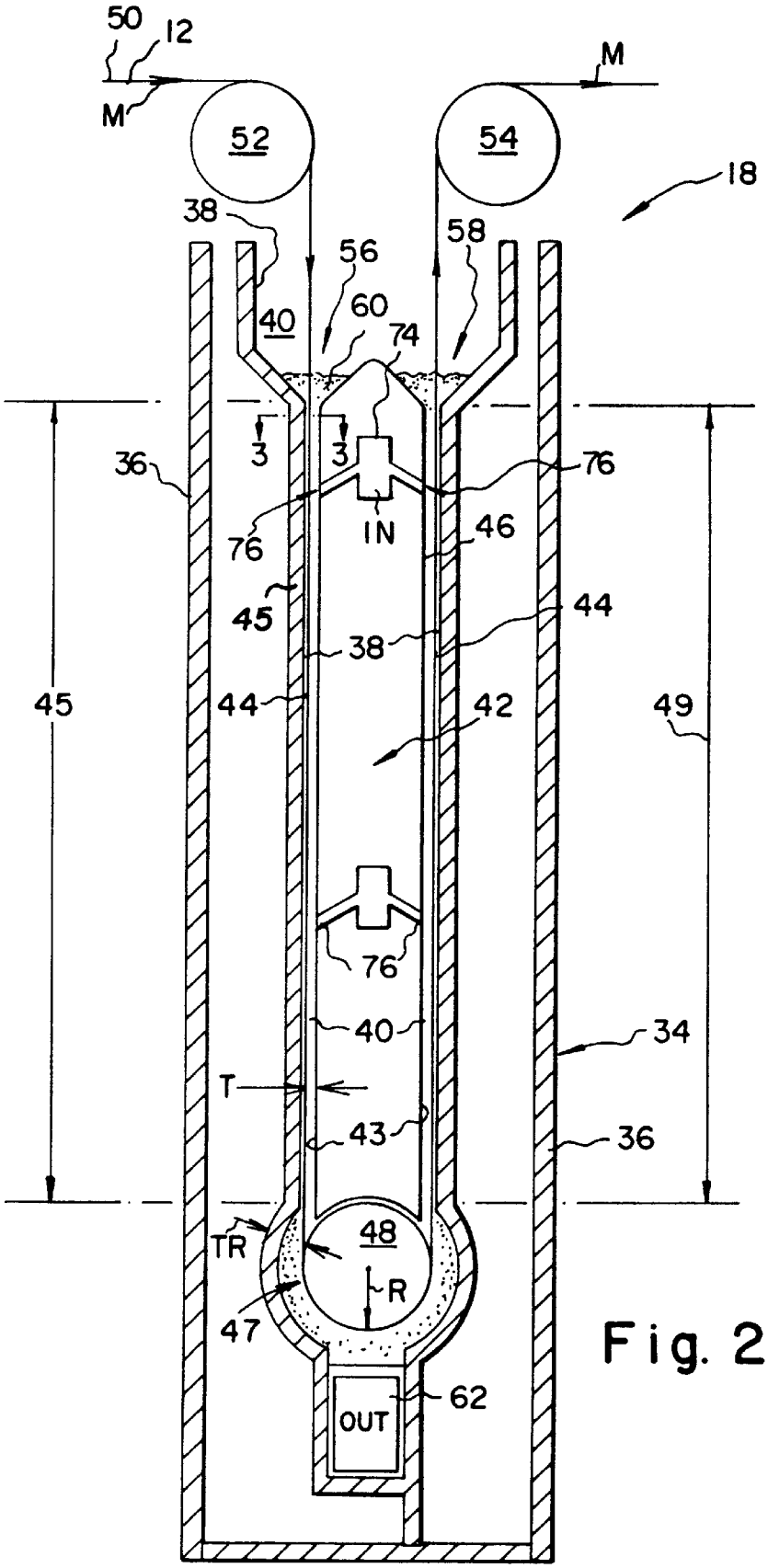
FIG. 2 is a schematic view illustrating one of the processing tanks illustrated in FIG. 1.
Figure 7:
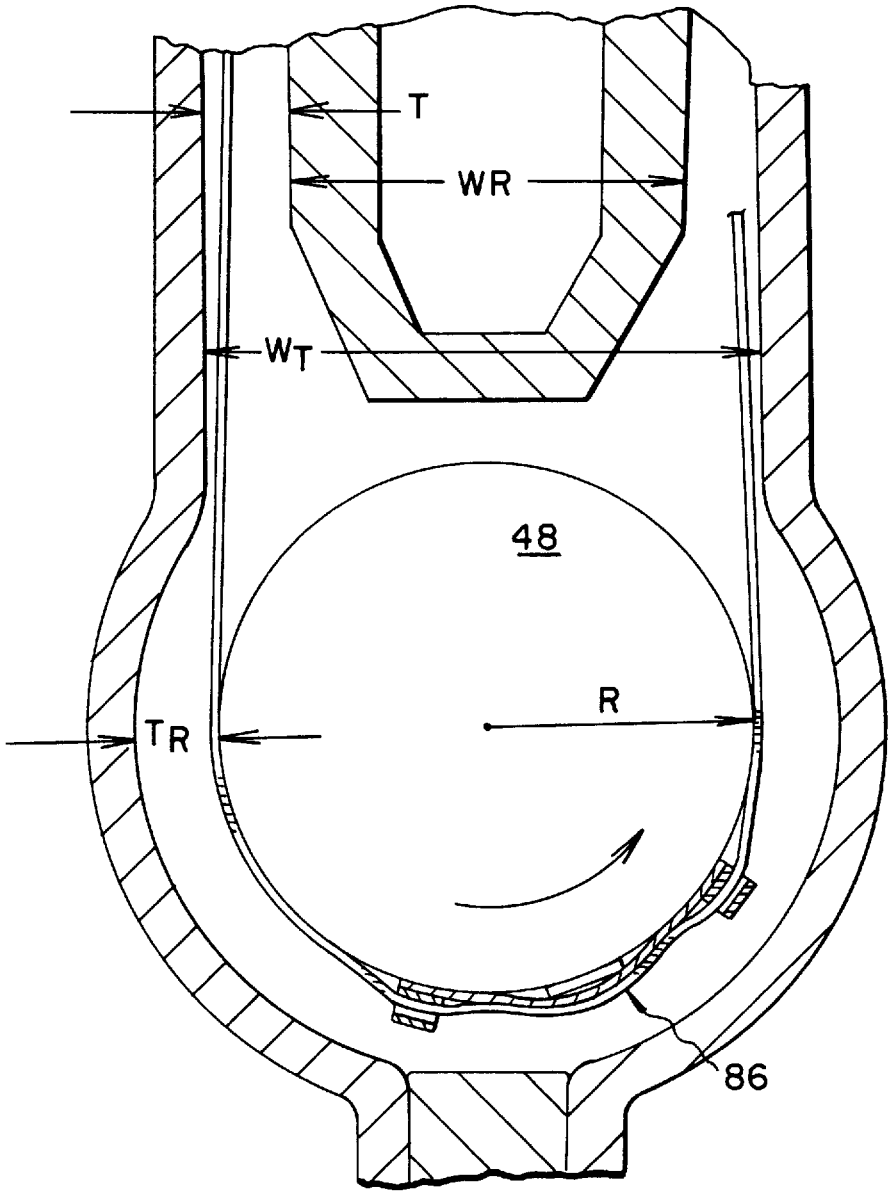

FIG. 7 an enlarged cross-sectional view of the turn-around section of the tank of FIG. 2.

DETAILED DESCRIPTION OF THE INVENTION

Figure 1:
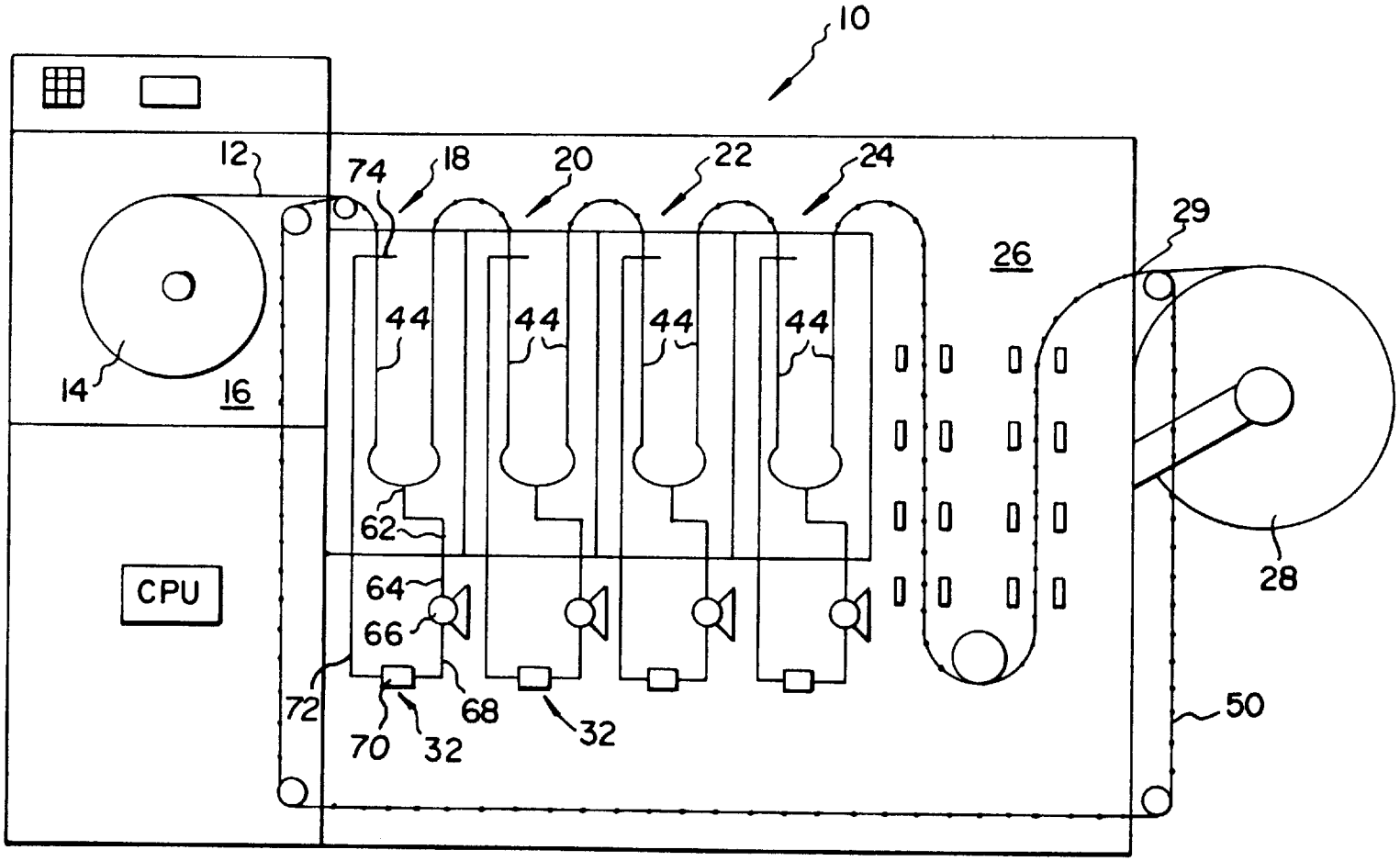
FIG. 1 is a schematic view illustrating a processing apparatus made in accordance with the present inventions.

Referring to FIG. 1, there is illustrated a processing apparatus 10 made in accordance with the present invention for processing a photosensitive material 12. In the particular embodiment illustrated, the photosensitive material 12 is provided on a supply roll 14 that is placed in supply chamber 16. The photosensitive material 12 is fed from the supply roll 14 through a plurality of processing stations 18, 20, 22, 24 wherein the photosensitive material is subjected to different photographic processing solutions. In the particular embodiment illustrated, the processing station 18 is designed for subjecting the photosensitive material 12 to a photographic developing solution; photoprocessing station 20 is designed to subject the photosensitive material to a photographic bleach/fix processing solution; and stations 22, 24 are designed to subject the photosensitive material to rinse solutions. It is, of course, understood that any desired number of processing stations with appropriate processing solutions may be provided in accordance with the photosensitive material being processed. In the particular embodiment illustrated, the photosensitive material 12 is photographic paper, however, the present invention is not limited to such.

After leaving processing station 24, the photosensitive material is passed through dryer section 26 where it is dried and then passed on out of the apparatus 10 through an exit 29 onto a take-up roll 28.

Each of the processing stations 18, 20, 22, 24 are of the low volume thin tank type, that is, a narrow processing channel 44 is provided for containing of the processing solution through which the photosensitive material passes. Additionally, a minimal amount of processing solution is provided in each of the recirculation systems 32 associated with each of the stations.

Referring to FIG. 2, there is illustrated in greater detail the rack and tank construction of processing station 18. It is to be understood that the other processing stations 20, 22, 24 are similarly constructed. The processing station 18 includes a processing tank 34 having an exterior wall 36 and a generally U-shaped inner wall 38 which forms chamber 40. Disposed within chamber 40 is a rack 42, which has an exterior wall 43 shaped such that narrow processing channel 44 is formed between the exterior wall 43 of rack 42 and inner wall 38 of chamber 40. In the embodiment illustrated, channel 44 comprises a first straight section 45, a turn-around section 47, and a second straight section 49. Attached to the lower end of rack 42 there is provided a turn-around roller 48 which forms turn-around section 47. In the particular embodiment illustrated, a continuous belt 50 is provided for transporting of the photosensitive material 12 through the processor 10. A pair of guide rollers 52, 54 are provided for guiding of the belt 50 into the entrance 56 of channel 44 and exit 58 of channel 44. A photographic processing solution 60 is placed in the processing channel 44 formed between the rack 42 and tank 34.

Referring to FIGS. 1 and 2, the processing solution is recirculated through the processing channel 44. In particular, the processing solution is withdrawn from the processing channel 44 through outlet 62 and is directed through an appropriate conduit 64 to recirculation pump 66. The pump 66 circulates the processing solution through conduit 68, filter assembly 70, and then through conduit 72 to inlet 74 provided in rack 42. The inlet 74 is in turn connected to a pair of slot nozzles 76, which extend across the rack (see FIG. 5) for allowing impingement of the processing solution against the photosensitive material 12 passing through the processing channel 44.

Figure 5:
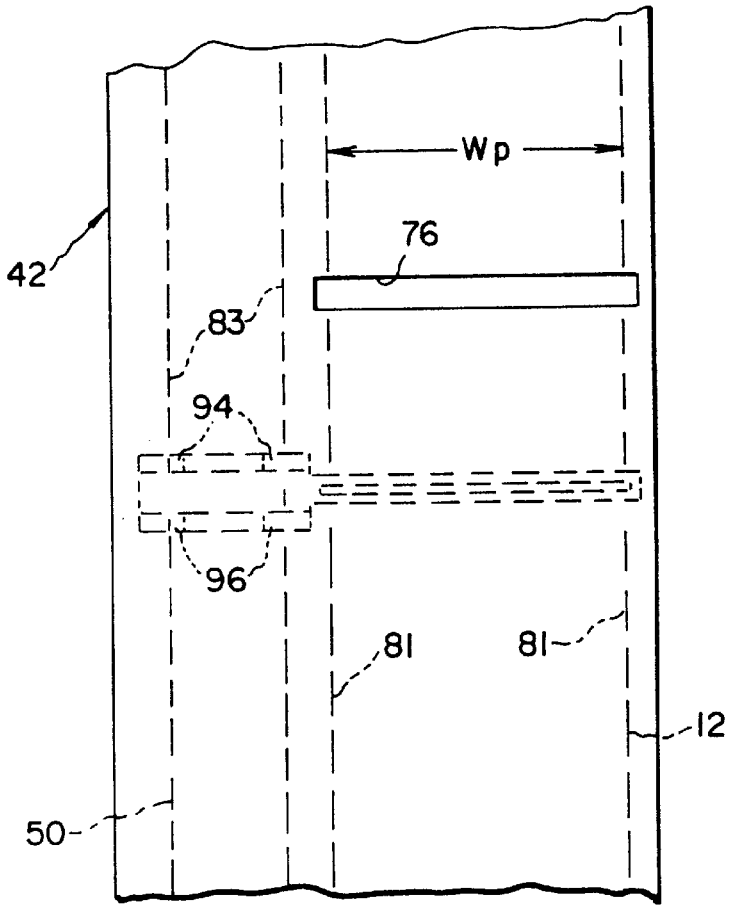
FIG. 5 is a partial elevational view of the rack of FIG. 3 as taken along line 5—5.

Referring to FIG. 5, there is illustrated a partial elevational view of rack 42, as taken along line 5—5 of FIG. 2. Dash lines 81 indicate the lateral edges of the photosensitive material 12 as it passes through channel 44. The width of the photosensitive material 12 is indicated by WP. Dash lines 83 illustrate the position of the lateral edges of the belt 50 within channel 44.

Figure 3:
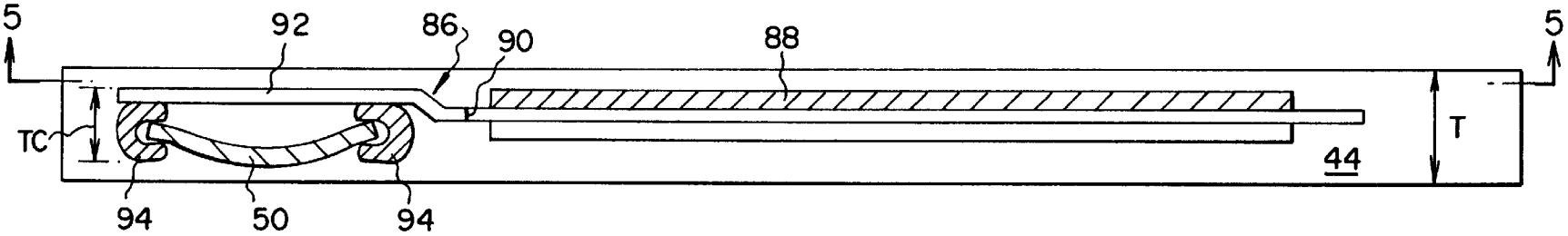
FIG. 3 is a cross-sectional view of the apparatus of FIG. 2 as taken along line 3—3 of FIG. 2.
Figure 6:
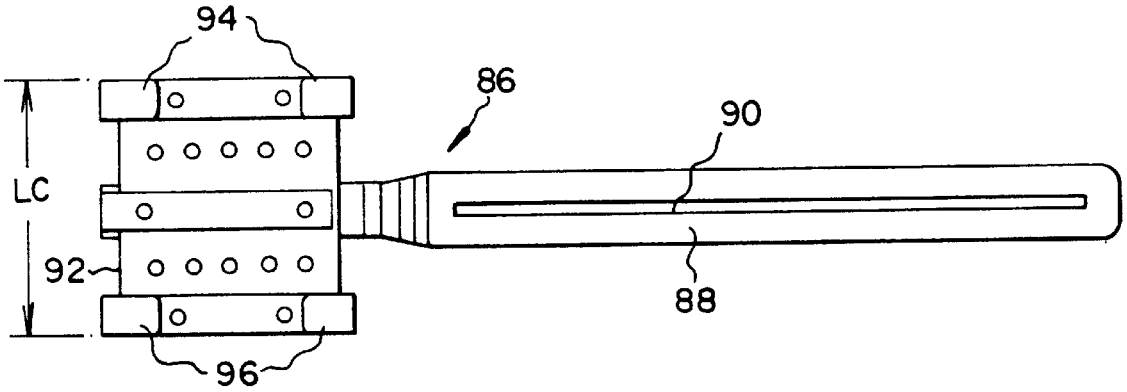
FIG. 6 is an enlarged plan view of the clip of FIG. 3.

Referring to FIG. 3, there is illustrated a cross-sectional view of the processing channel 44 as taken along line 3—3 of FIG. 2. As previously discussed, clip 86 is provided for transporting of the photosensitive material 12 through the processor 10. Referring to FIG. 6, clip 86 includes an attachment section 88 for attaching to the end of the photosensitive material 12. Typically, the attachment section 88 includes an elongated slot 90 through which the end of the photosensitive material 12 passes and is wrapped thereabout. The clip 86 also includes a mounting section 92 for attachment to belt 50, which is appropriately driven in a continuous loop through the processor. In the particular embodiment illustrated, the mounting section 92 includes two pair of spaced C-clip members 94, 96 which slightly deform the belt 50 and thereby provide a sufficient amount of tension for securing of the clip 86 to belt 50. Thus, as the belt 50 moves, the clip 86 will also move, thereby transporting the photosensitive material 12 through the processor. It is, of course, understood that various other design configurations for the clips may be provided as appropriate for the processor.

As can be seen in FIG. 3, the processing channel 42 has a thickness T which is designed to be of sufficient width to allow the clip 86 and photosensitive material 12 to pass therethrough, but not too thick as to contain large amounts of processing solution.

In a typical rack and tank type processing system, there is a relatively high radius turn through which the belt 50 and photosensitive material must pass. Typically, the turn-around section 47 has a radius of curvature greater than 0.01 mm, generally greater than about 0.02 mm. As illustrated in FIGS. 2 and 7, the photosensitive material must pass around roller 48. In the particular embodiment illustrated, the roller 48 has a diameter D (equal to 2 R). The diameter D of roller 48 is preferably less than the width WT of the chamber 40, but greater than the width WR of the rack 42. This assists in keeping the emulsion side of the material 12 from contacting the outer wall 43 of rack 42. Applicants have found that due to the construction of the clip 86, and going through a sharp radius turn, there exists the possibility that the clip 86 may scrap, damage, or even disengage the belt 50 as it goes around the roller 48. It is extremely important that the clip 86 not be dislodged or scrapped on the side of the processing tank. This can result in serious damage to the equipment and to the photosensitive material passing through, and thus require substantial amounts of time to repair should it become necessary to remove the clip, not to mention the damage to the customer's photosensitive material. In typical prior art processors where a rack is simply placed in a large tank of solution, if the clip were to disengage the belt, the clip would simply sink to the bottom and stay there until normal maintenance of the tank occurred. However, in a low volume thin processor having a narrow processing channel, it is not possible to wait to remove the dislodged clip. Therefore, to minimize the possibility of the clip hanging up, the lower portion of the processing channel in the area of the turn-around section 47 is made larger in cross-sectional thickness. Thus, the thickness of the processing channel in the turn-around section 47 is made such that the processing channel 44 has a thickness TR, which is greater than the thickness T of the processing straight sections 45, 49 of the processing channel 44. Preferably TR is equal to or less than 150% of thickness T, most preferably equal to or less than 125%. The thickness TR will vary in accordance with the size of the radius R and the size of the clip 86. In the particular embodiment, as shown in FIG. 3, the clip 86 has a thickness TC in the mounting section 92. TC is the largest thickness of the clip 86 and, therefore, is the most critical part that must be taken into account when determining the thickness TR of the turn-around section 47. It is also important to take into account the length LC of the clip 86 (see FIG. 6), as this will also have an affect on the thickness TR required for the clip 86 to properly turn around radius R. Due to these large number of variables, the thickness TR can be determined once the thickness TC, the length LC, and the radius of curvature R of the roller are known. In the particular embodiment illustrated, the roller 48 has a radius R of about 42 mm, and the clip 86 has a thickness TC of about 10 mm and a length LC of about 40 mm and a thickness T of about 6 mm. Applicants have found that when using a clip 86 having this size relationship, the thickness TR should be in the range of about 6.5 mm to 30 mm, preferably from about 6.5 mm to 16.0 mm. It can be seen that the thickness TR will need to be greater than the thickness T, and in most situations where it is desirable to minimize the thickness T of the processing channel 44.

In the embodiment illustrated in FIG. 6, the clip members 94, 96 are connected by a flexible support member 95 which assists in conforming the mounting section 92 to the radius of the roller 48. A more detailed description of clip 86 is found in co-pending U.K. Patent Application No. 970030340; filed Feb. 14, 1997 entitled "A Clip", which is hereby incorporated herein in its entirety.

Figure 4:
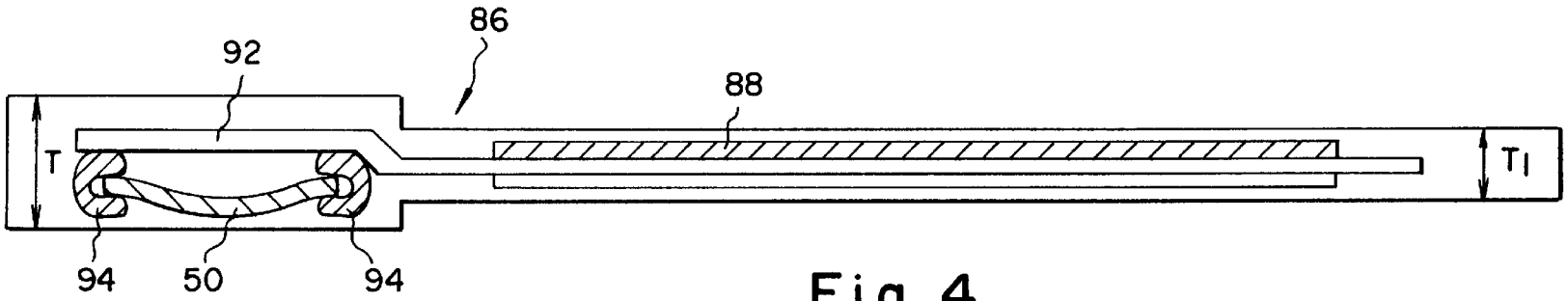
FIG. 4 is a view similar to FIG. 3 illustrating a modified processing channel made in accordance with the present invention.

In the particular embodiment illustrated, the thickness TR is substantially uniform across the processing channel 44. However, the present invention does not require this. It is only necessary to have the size of the channel increased only in those areas required and only to the extent necessary for that portion of the clip and photosensitive material so as to allow them to easily pass. Referring to FIG. 4, there is illustrated a modified cross-sectional view of a processing channel made accordance with the present invention. It can be seen in this particular embodiment the thickness T1 of the processing channel in the area of the attachment section is less than the thickness T of the processing channel 44 in the area of the mounting section 92 of the clip 86. Since it is the area of the belt and mounting section that requires the additional substantial turning radius, only that area of the channel need be increased. In the embodiment illustrated the thickness T1 is about 5.5 mm. The thickness TR in the turn-around section 47 may also vary across the width of the processor. The thickness TR of the turn-around section 47 may be thicker in the area of the mounting section than the attachment section which holds the photosensitive material. For example, the turn-around section 47 only in the area of the mounting section 92 may have a thickness equal to or less than 150% of the thickness T of the channel, preferably equal to or less than 125%.

The processing station 18 is of the low volume thin tank type construction. That is, a relatively small amount of processing solution is allowed in the processing channel 44 and the recirculation system 32. This is accomplished by providing a relatively narrow processing channel and by minimizing the amount of processing solution passing through the recirculation system. For the purposes of the present invention, a low volume thin tank processor is a processor wherein the ratio of the total volume of processing solution (i.e., processing solution within the processing channel and recirculation system) to the maximum area of the photosensitive material that can be accommodated within the processing channel is less than 25 $dm^3/mm^2$. Preferably, this ratio is less than 11 $dm^3/mm^2$, and most preferably, less than about 3 $dm^3/mm^2$. The total volume of the processing solution within the processing channel 44 is preferably such that the volume of the processed solution in the processing channel comprises at least 40% out of the total processing solution available in the processing channel 44 and recirculation system 32. Preferably, this ratio it at least 50%.

In order to provide efficient flow of the processing solution through slot nozzles 76, it is desirable that the nozzles deliver the processing solution in accordance with the following relationship:

$$0.6 \leq F/A \leq 23$$

wherein:

F is the flow rate of solution through the nozzle in liters/minute; and

A is a cross-sectional area of the nozzle 76 provided in $cm^2$.

Providing a nozzle in accordance with the foregoing relationship assures a proper discharge of the processing solution against the photosensitive solution. Examples of low volume thin tank processing systems are described and disclosed in the following patent specifications: U.S. Pat. No. 5,294,956; U.S. Pat. No. 5,179,404; U.S. Pat. No. 5,270,762; EP 559 025; EP 559026; EP 559 027; WO92/10790; WO92/17819; WO93/04404; WO92/17370; WO91/19226; WO91/12567; WO92/07302; WO93/00612; and WO92/07301.

Thus, it can be seen that there is provided an apparatus wherein a low volume thin tank processor is provided, yet appropriate accommodations are made for allowing the clip to easily pass through the processing channel without scraping the sides of the processing channel, or becoming lodged therein, thereby causing damage to the processor or to the photosensitive material being processed.

It is to be understood that various other changes and modifications may be made without departing from the scope of the present invention, the present invention being limited by the following claims.

| Parts List: | |
|---|---|
| 10 | apparatus |
| 12 | photosensitive material |
| 14 | supply roll |
| 16 | supply chamber |
| 18,20,22,24 | processing stations |
| 26 | dryer section |
| 28 | take-up roller |
| 30 | narrow processing channel |
| 32 | recirculation systems |
| 34 | processing tank |
| 36 | exterior wall |
| 38 | inner wall |
| 40 | chamber |
| 42 | rack |
| 43 | exterior wall |
| 44 | narrow processing channel |
| 45 | first straight section |
| 47 | turn-around section |
| 48 | turn-around roller |
| 49 | second straight section |
| 50 | continuous belt |
| 52,54 | guide rollers |
| 56 | entrance |
| 58 | exit |
| 60 | photographic processing solution |
| 62 | outlet |
| 64 | conduit |
| 66 | recirculation pump |
| 68 | conduit |
| 70 | filter assembly |
| 72 | conduit |
| 74 | inlet |
| 76 | slot nozzles |
| 81,83 | dash lines |
| 86 | clip |
| 88 | attachment section |
| 90 | elongated slot |
| 92 | mounting section |
| 94,96 | C-clip member |
| 95 | flexible support member |

We claim:

1. A photographic processor for processing a photosensitive material, said processor comprising at least one processing section having a generally U-shaped processing channel for holding a processing solution through which the photosensitive material passes, and a belt for transporting of the photosensitive material through said generally U-shaped processing channel, said generally U-shaped channel comprising a first generally straight section in which the photosensitive material enters the processing channel, a second generally straight section through which the photosensitive material exits the U-shaped processing channel, and a turn-around section connecting the first and second sections, said turn-around section having a radius of curvature of a predetermined value, said first and second straight sections having a cross-sectional thickness T, and said turn-around section having a cross-sectional thickness TR greater than the cross-sectional thickness T.

2. A processor according to claim 1 wherein the thickness TR is equal to or less than 125% of the thickness T.

3. A processor according to claim 1 wherein the thickness TR is equal to or less than 150% of the thickness T.

4. A processor according to claim 1 wherein a clip is utilized for securing the photosensitive material to the belt for transporting of the photosensitive material through the processing channel, said clip having a photosensitive material attachment section for attaching of the photosensitive material to the clip and a belt attachment section for attachment to the belt, the thickness TR is less than the thickness of the attachment section of the clip.

5. A processor according to claim 1 wherein the radius of curvature of the turn-around section is equal to or greater than 0.01 mm.

6. A processor according to claim 1 wherein the radius of curvature of the turn-around section is equal to or greater than 0.02 mm.

7. A processor according to claim 1 wherein said turn-around section has a turn-around roller having a radius of about 42 mm.

8. A photographic processor for processing a photosensitive material, said processor comprising at least one processing section having a generally U-shaped processing channel for holding a processing solution through which the photosensitive material passes, and a belt for transporting of the photosensitive material through said generally U-shaped processing channel, said generally U-shaped channel comprising a first generally straight section in which the photosensitive material enters the processing channel, a second generally straight section through which the photosensitive material exits the U-shaped processing channel, and a turn-around section connecting the first and second sections, said turn-around section having a radius of curvature greater or equal to 0.01 mm, said first and second straight sections having a thickness T, said turn-around section having a thickness TR equal to or less than 150% of thickness T.

9. A photographic processor for processing a photosensitive material, said processor comprising:

at least one processing section having a tank having generally U-shaped processing chamber and a rack for placement within said chamber, said chamber having a width WT and said rack having a width WR, said rack and tank form a narrow processing channel having a thickness T therebetween for holding a processing solution through which the photosensitive material passes, and a belt for transporting of the photosensitive material through said generally U-shaped processing channel, said generally U-shaped channel comprising a first generally straight section in which the photosensitive material enters the processing channel, a second generally straight section through which the photosensitive material exits the U-shaped processing channel, and a turn-around section connecting the first and second sections, said turn-around section having a guide roller having a diameter less than the width WT but greater than the width WR of said rack.

10. A processor according to claim 9 wherein said turn-around section has a cross-sectional thickness TR greater than the cross-sectional thickness T.

11. A processor according to claim 10 wherein the thickness TR is equal to less than 125% of the thickness T.

12. A processor according to claim 10 wherein the thickness TR is equal to or less than 150% of the thickness T.

13. A photographic processor for processing a photosensitive material, said processor comprising at least one processing section having a generally U-shaped processing channel for holding a processing solution through which the photosensitive material passes, and a belt designed for use with a clip for transporting of the photosensitive material through said generally U-shaped processing channel, the clip having a mounting section for attachment to the belt and a attachment section which hold the photosensitive material, said generally U-shaped channel comprising a first generally straight section in which the photosensitive material enters the processing channel, a second generally straight section through which the photosensitive material exits the U-shaped processing channel, and a turn-around section connecting the first and second sections, said turn-around section having a cross-sectional thickness greater in the area of the mounting section of the clip than the attachment section which holds the photosensitive material.

14. A processor according to claim 13 wherein the thickness said turn-around section in the mounting section is equal to or less than 125% of the thickness the channel.

15. A processor according to claim 13 wherein the thickness said turn-around section in the mounting section is equal to or less than 150% of the thickness the channel.

16. A processor according to claim 13 wherein the turn-around section has a radius of curvature is equal to or greater than 0.01 mm.

17. A processor according to claim 13 wherein the turn-around section has a radius of curvature is equal to or greater than 0.02 mm.

18. A processor according to claim 13 wherein said turn-around section has a turn-around roller having a radius of about 42 mm.

* * * * *